US011696057B2

(12) United States Patent
Xiao et al.

(10) Patent No.: US 11,696,057 B2
(45) Date of Patent: Jul. 4, 2023

(54) SPEAKER BOX AND MOBILE TERMINAL

(71) Applicant: AAC Microtech (Changzhou) Co., Ltd., Changzhou (CN)

(72) Inventors: Mushu Xiao, Shenzhen (CN); Shuwen Wu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/536,095

(22) Filed: Nov. 29, 2021

(65) Prior Publication Data

US 2022/0174383 A1 Jun. 2, 2022

(30) Foreign Application Priority Data

Nov. 30, 2020 (CN) ..... 202022830405.1

(51) Int. Cl.
*H04R 1/02* (2006.01)

(52) U.S. Cl.
CPC ..... *H04R 1/023* (2013.01); *H04R 2499/11* (2013.01)

(58) Field of Classification Search
CPC ..... H04R 1/023; H04R 2499/11
See application file for complete search history.

(56) References Cited

U.S. PATENT DOCUMENTS 7,894,620 B2 * 2/2011 Yang ..... H04R 1/021 381/345
9,525,933 B2 * 12/2016 Chen ..... H04R 1/2842
9,883,266 B2 * 1/2018 Dai ..... H04R 9/06
10,149,062 B2 * 12/2018 Zhang ..... H04R 1/06
10,356,498 B2 * 7/2019 Yoon ..... H04R 1/025
2012/0275637 A1 * 11/2012 Liao ..... H04R 1/025 381/395
2013/0094685 A1 * 4/2013 Seo ..... H04R 1/021 381/332
2013/0223655 A1 * 8/2013 Lee ..... H04R 1/34 381/189
2016/0323003 A1 * 11/2016 Shi ..... H01Q 1/38
2019/0058933 A1 * 2/2019 Huo ..... H04R 1/2811
2020/0221209 A1 * 7/2020 Grebe ..... H01M 50/216

FOREIGN PATENT DOCUMENTS

WO WO-2018057862 A1 * 3/2018 ..... H04R 1/023

* cited by examiner

*Primary Examiner* — Oyesola C Ojo
(74) *Attorney, Agent, or Firm* — W&G Law Group

(57) ABSTRACT

Provided is a speaker box and a mobile terminal. The speaker box is applied to the mobile terminal and includes a shell having a receiving space and a speaker unit received in the receiving space. The shell includes a bottom shell and a metal top plate covering the bottom shell and together defining the receiving space. The metal top plate includes a main body covering one end of the sidewall away from the bottom wall and a connector extending outwards from the main body. A positioning portion is provided in the connector. The housing extends toward the connector to form a heat stake supporting and fixing the connector. The connector is fixed to the housing after hot melting of the heat stake. A stable connection between the speaker box and the mobile terminal can be achieved and mounting is fast and firm.

10 Claims, 3 Drawing Sheets

SPEAKER BOX AND MOBILE TERMINAL

TECHNICAL FIELD

The present disclosure relates to the technical field of mobile electronic product, and in particular, to a speaker box and a mobile terminal.

BACKGROUND

With the rapid development of mobile electronic products, increasingly high requirements are put forward on functionality of mobile terminals, especially speakers in the mobile terminals. In a speaker box in the related art, a metal shell is used in one type of speakers, which lacks effective positioning and fastening manners in the mobile terminal due to its structural limitation. After long-term use, such speaker box is easy to loose, which may adversely affect sound quality of the speaker and cannot stably and reliably output high-quality sound.

SUMMARY

An objective of the present disclosure is to provide a speaker box and a mobile terminal, so as to solve the shortcomings in the related art to certain extent.

In order to achieve the above objective, the present disclosure provides a speaker box applied to a mobile terminal. The mobile terminal has a housing receiving the speaker box. The speaker box includes a shell having a receiving space and a speaker unit received in the receiving space and having a diaphragm. A front sound cavity is formed between the shell and the speaker unit, and the shell is provided with a sound output hole communicated with the front sound cavity. The shell includes a bottom shell and a metal top plate covering the bottom shell, the bottom shell and the metal top plate together define the receiving space. The bottom shell includes a bottom wall opposite to and spaced from the metal top plate and a sidewall bending and extending from a periphery of the bottom wall toward the metal top plate. The metal top plate includes a main body covering one end of the sidewall away from the bottom wall and a connector extending outwards from the main body. A positioning portion is provided in the connector. The housing extends toward the connector to form a heat stake supporting and fixing the connector. The heat stake matches the positioning portion and passes through the positioning portion. The connector is fixed to the housing after hot melting of the heat stake.

As an improvement, the positioning portion is a through hole running through the connector.

As an improvement, the housing is provided with a positioning block corresponding to the connector, the positioning block is provided with a positioning slot configured to accommodate the connector, and the heat stake is formed in the positioning slot.

As an improvement, the connector includes a bending portion connected to the main body and obliquely bending toward the bottom wall and a connection portion protruding outwards from one side of the bending portion away from the main body and parallel to the main body, and the positioning portion is formed on the connecting portion.

As an improvement, the speaker box further includes a fixing holder, the fixing holder includes an annular frame received in the receiving space and configured to fix the speaker unit and a sound guide structure protruding from one side of the annular frame and extending out of the sidewall. The annular frame, the diaphragm and the metal top plate together define the front sound cavity. A sound guide through hole communicated with the front sound cavity is formed in the sound guide structure. One end of the sound guide structure away from the annular frame is provided with the sound output hole, and the sound output hole is communicated with the front sound cavity through the sound guide through hole.

As an improvement, the annular frame includes an annular body and a stopper projecting from one end of an inner side of the annular body close to the metal top plate to a center of the annular body, and the annular body engages with the stopper to form a step limiting the speaker unit.

As an improvement, one side of the stopper away from the annular body forms an inclined surface towards the diaphragm.

As an improvement, an edge of the sidewall close to the metal top plate is provided with a mounting recess fitting with the sound guide structure.

As an improvement, the sound guide structure is further provided with a dust screen completely covering the sound output hole.

As an improvement, one end of the sound guide structure away from the annular frame is provided with a groove configured to mount and fix the dust screen.

The present disclosure further provides a mobile terminal, including a housing having an accommodating cavity and the speaker box described above received in the accommodating cavity. A heat stake is formed on the housing. The speaker box is positioned through cooperation between the positioning portion and the heat stake and is fixed to the housing after hot melting of the heat stake.

In the present disclosure, when the speaker box is assembled with the housing, the positioning portion on the connector may coordinate with the heat stake on the housing to achieve rapid positioning, and the connector is fastened to the housing by hot-melting the heat stake, so as to achieve a stable connection between the speaker box and the mobile terminal and fast and firm mounting.

BRIEF DESCRIPTION OF DRAWINGS

In order to more clearly illustrate the technical solutions in embodiments of the present disclosure or the related art, the accompanying drawings used in the description of the embodiments or the related art will be briefly introduced below. It is apparent that, the accompanying drawings in the following description are only some embodiments of the present disclosure, and other drawings can be obtained by those of ordinary skill in the art from the structures shown in the provided drawings without creative efforts.

Figure 1:
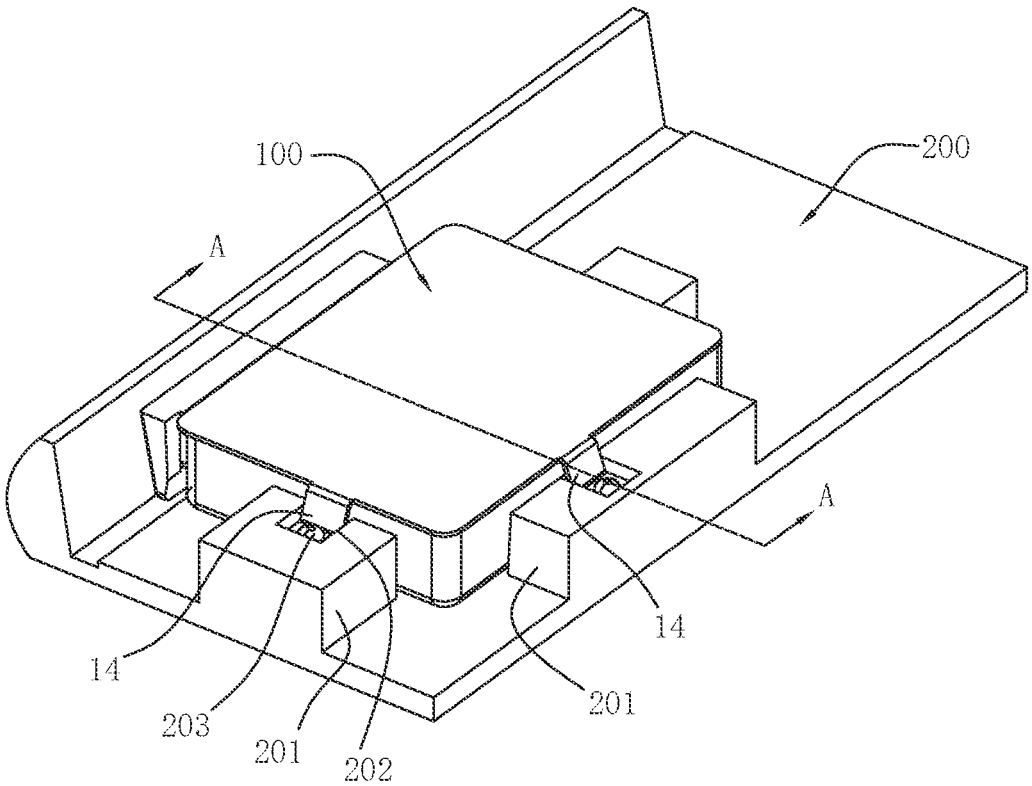
FIG. 1 is a schematic diagram of a perspective structure of a mobile terminal according to an embodiment of the present disclosure.

Implementation of the objectives, functional characteristics and advantages of the present disclosure are further described below with reference to the accompanying drawings.

DESCRIPTION OF EMBODIMENTS

Embodiments of the present disclosure will be described in detail below. Examples of the embodiments are illustrated in the accompanying drawings, in which the same or similar reference numerals are used to indicate the same or similar elements or elements having the same or similar functions. The embodiments described below by reference to the accompanying drawings are exemplary and intended to provide explanation of the present disclosure, which cannot be construed as the limitation of the present disclosure. All other embodiments acquired by those skilled in the art without creative efforts based on the embodiments of the present disclosure shall fall within the protection scope of the present disclosure.

In the present disclosure, unless otherwise specifically stated and limited, the terms such as "mounting," "coupling," "connection" and "fixing" should be understood in a broad sense, such as a fixed connection, a detachable connection, or an integral connection; a mechanical connection or an electrical connection; a direct connection, an indirect connection through an intermediate medium, or an internal connection of two elements. For those of ordinary skill in the art, the specific meanings of the foregoing terms in the present disclosure can be understood case-by-case.

The technical solutions in the embodiments of the present disclosure are described in detail below with reference to the accompanying drawings.

Figure 2:
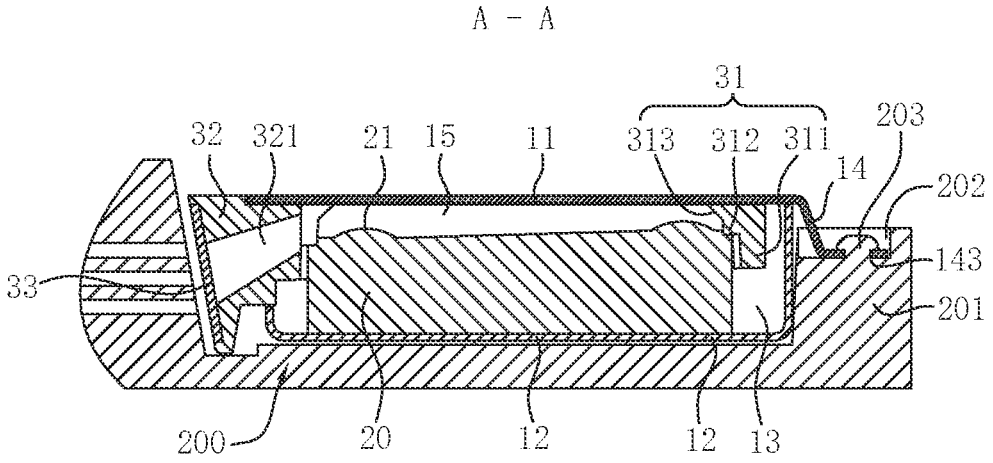
FIG. 2 is a sectional view taken along a direction A-A in FIG. 1.
Figure 3:
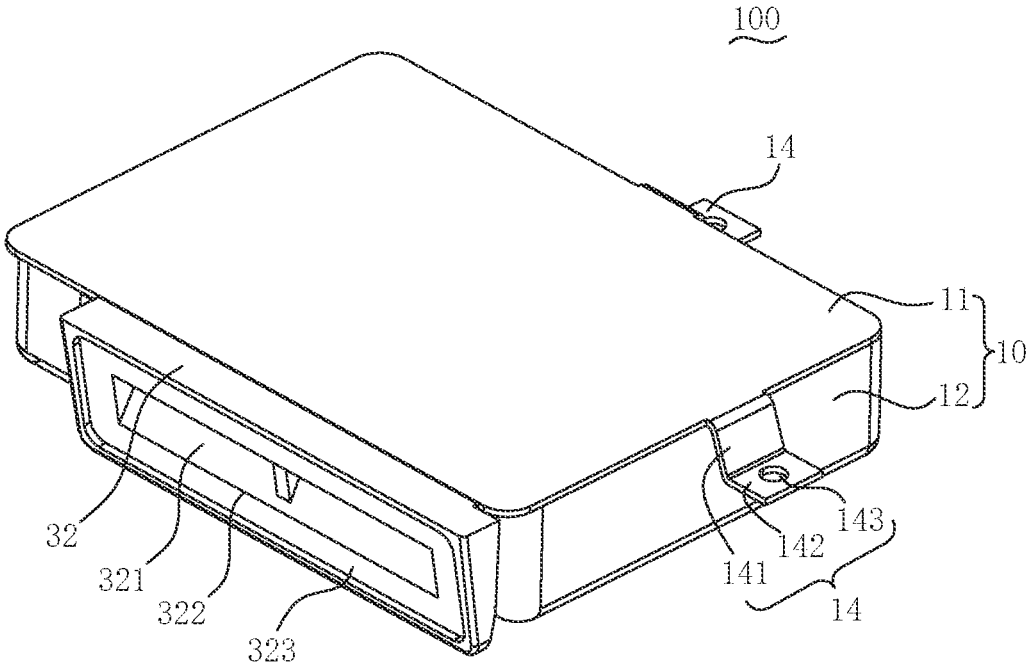
FIG. 3 is a schematic diagram of a perspective structure of a speaker box shown in FIG. 1.
Figure 4:
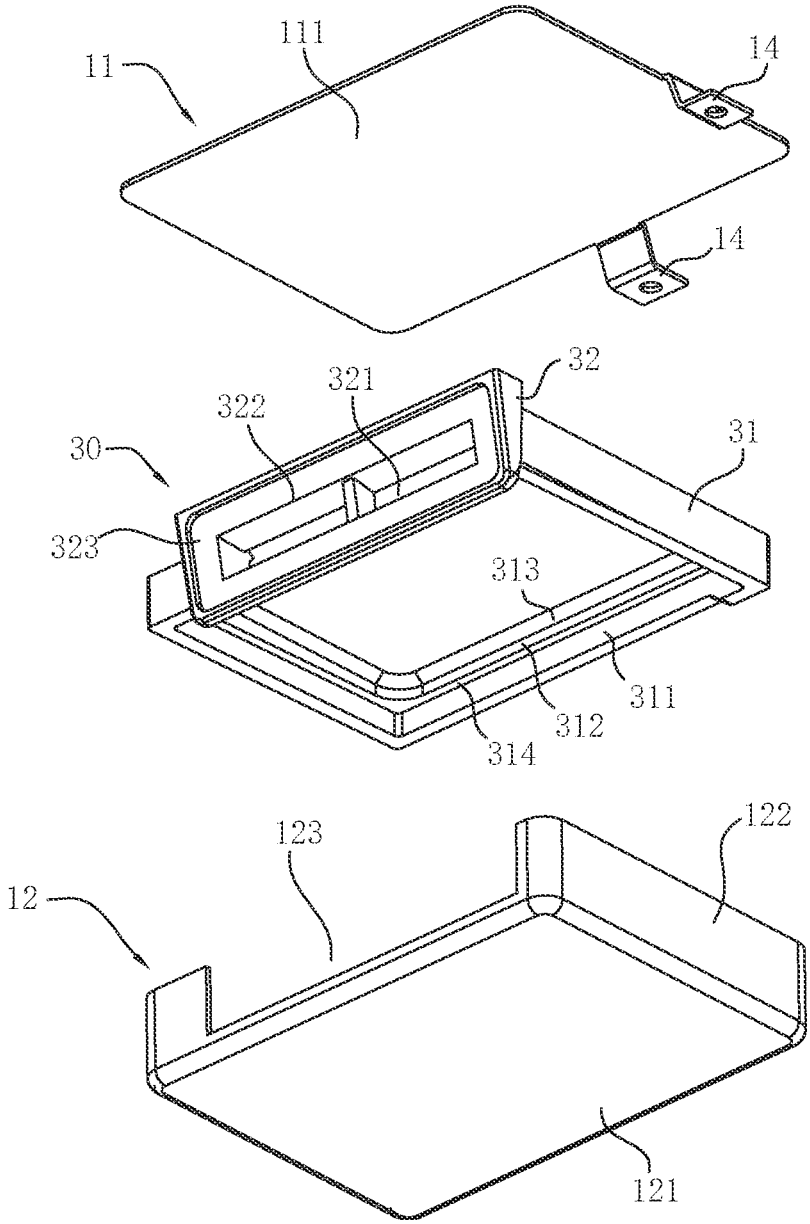
FIG. 4 is a schematic diagram of an exploded structure of FIG. 3.

FIG. 1 to FIG. 4 show a mobile terminal according to some embodiments of the present disclosure. The mobile terminal includes a housing 200 having an accommodating cavity and a speaker box 100 received in the accommodating cavity.

The speaker box 100 is configured to vibrate and sound to implement functions of the mobile terminal such as play music or voice information. The speaker box includes a shell 10 having a receiving space 13, and a speaker unit 20 received in the receiving space 13 and having a diaphragm 21. A front sound cavity 15 is formed between the shell 10 and the speaker unit 20. The shell 10 is provided with a sound output hole 322 communicating with a front sound cavity 15.

The shell 10 includes a bottom shell 12 and a metal top plate 11 covering the bottom shell 12. The metal top plate 11 and the bottom shell 12 together define the receiving space 13. The bottom shell 12 includes a bottom wall 121 opposite to and spaced from the metal top plate 11, and a sidewall 122 bending and extending from a periphery of the bottom wall 121 toward the metal top plate 11. The metal top plate 11 includes a main body 111 covering one end of the sidewall 122 away from the bottom wall 121 and a connector 14 extending outwards from the main body 111. A positioning portion is provided in the connector 14. In this embodiment, the positioning portion is a through hole 143 running through the connector. It is appreciated that, in other embodiments, the positioning portion may also be of a bayonet structure.

A heat stake 203 matching the through hole 143 is formed at a position on the housing 200 of the mobile terminal corresponding to the through hole 143. In this embodiment, when the speaker box 100 is assembled with the housing 200, the through hole 143 in the connector 14 may coordinate with the heat stake 203 on the housing 200 to achieve rapid positioning. That is, the heat stake 203 passes through the through hole 143, and the connector 14 is then fastened to the housing 200 by hot-melting the heat stake 203, so as to achieve a stable connection between the speaker box 100 and the mobile terminal through fast and firm mounting.

In an embodiment, the housing 200 may protrude to form a positioning block 201. The positioning block 201 is provided with a positioning slot 202 configured to accommodate the connector 14, and the heat stake 203 running through the through hole 143 is formed in the positioning slot 202, so that the heat stake 203 is more conveniently sleeved therein through the coordination between the positioning slot 202 and the connector 14, and thus the assembly is more convenient.

In this embodiment, the main body 111 is provided with two connectors 14 formed on two adjacent sides or two opposite sides of the main body 111. It is appreciated that, in other embodiments, more connectors 14 may be formed on the main body 111, which is not particularly limited in the present disclosure.

In order to prevent an increase in a thickness of the mobile terminal caused by mounting of the speaker box 100 to the mobile terminal, the connector 14 includes a bending portion 141 connected to the main body 111 and obliquely bending toward the bottom wall 121, and a connection portion 142 protruding outwards from one side of the bending portion 141 away from the main body 111 and parallel to the main body 111. The through hole 143 is formed on the connecting portion 142. That is, a height of a top surface of the positioning block 201 may be lower than a height of the metal top plate 11. In this way, the thickness of the mobile terminal may not be increased due to the arrangement of the positioning block 201 after the speaker box 100 is fixed to the housing 200 through hot melting of the heat stake 203.

It is to be noted that the main body 111 and the connector 14 of the metal top plate 11 are of an integrally formed structure, which may be formed by sheet metal blanking and then bending, and thus the machining process is easy and efficient. Moreover, when the speaker box 100 is fixed to the housing 200 of the mobile terminal, the bottom shell 12 is pressed and fixed through the metal top plate 11, eliminating a connection structure between the metal top plate 11 and the bottom shell 12, and enabling the front sound cavity 15 formed therein to be better sealed, thereby improving the quality of sound produced by the diaphragm 21.

In one embodiment, in order to improve stability between the speaker unit 20 and the shell 10, the speaker box 100 further includes a fixing holder 30. The fixing holder 30 includes an annular frame 31 received in the receiving space 13 and configured to fix the speaker unit 20 and a sound guide structure 32 protruding from one side of the annular frame 31 and extending out of the sidewall 122. The annular frame 31, the diaphragm 21 and the metal top plate 11 together define the front sound cavity 15. A sound guide through hole 321 communicated with the front sound cavity 15 is formed in the sound guide structure 32. One end of the sound guide structure 32 away from the annular frame 31 is provided with the sound output hole 322, and the sound output hole 322 is communicated with the front sound cavity 15 through the sound guide through hole 321. The diaphragm 21 of the speaker unit 20 vibrates the air in the front sound cavity 15 to produce sound. The sound is transmitted out of the mobile terminal sequentially through the sound guide hole 321, the sound output hole 322 and a corresponding sound hole in the housing 200.

In an embodiment, the annular frame 31 includes an annular body 311 and a stopper 312 projecting from one end of an inner side of the annular body 311 close to the metal top plate 11 to a center of the annular body 311. The annular body 311 engages with the stopper 312 to form a step 314 limiting the speaker unit 20. Correspondingly, an edge of the sidewall 122 close to the metal top plate 11 is provided with a mounting recess 123 fitting with the sound guide structure 32. When the annular body 311 is received in the receiving space 13, the sound guide structure 32 is exactly located in the mounting recess 123.

In this way, during assembling, the speaker unit 20 is firstly placed in the bottom shell 12, and the annular frame 31 then covers the speaker unit 20, so as to press the stopper against a surface of the speaker unit 20. That is, a periphery of an upper end of the speaker unit 20 is just clamped in the step 314 of the annular frame 31. Then, the metal top plate 11 covers the fixing holder 30, and is fixed through hot melting of the heat stake 203, so that the bottom shell 12, the speaker unit 20, the fixing holder 30 and the metal top plate 11 form a relatively fixed entirety, and are then fixed to the housing 200 of the mobile terminal.

In this embodiment, one side of the stopper 312 away from the annular body 311 forms an inclined surface 314 towards the diaphragm 21. In this way, a volume produced by the speaker unit 20 may be increased by a sound rebound effect of the inclined surface 314 on the diaphragm 21.

In this embodiment, the sound guide structure 32 is further provided with a dust screen 33 completely covering the sound output hole 322. For example, one end of the sound guide structure 32 away from the annular frame 31 is provided with a groove 323 configured to mount and fix the dust screen 33. The dust screen 33 may be fixed into the groove 323 by adhesive bonding.

The above are only preferred embodiments of the present disclosure and not thus intended to limit the patent scope of the present disclosure. All equivalent structure transformations made by virtue of contents of the specification and the drawings of the present disclosure or direct/indirect application of the contents to the other related technical fields shall fall within the protection scope of the present disclosure.

What is claimed is:

1. A speaker box, applied to a mobile terminal having a housing receiving the speaker box, the speaker box comprising a shell having a receiving space and a speaker unit received in the receiving space and having a diaphragm, a front sound cavity being formed between the shell and the speaker unit, and the shell being provided with a sound output hole communicated with the front sound cavity;

wherein the shell comprises a bottom shell and a metal top plate covering the bottom shell, the bottom shell and the metal top plate together define the receiving space, the bottom shell comprises a bottom wall opposite to and spaced from the metal top plate and a sidewall bending and extending from a periphery of the bottom wall toward the metal top plate, the metal top plate comprises a main body covering one end of the sidewall away from the bottom wall and a connector extending outwards from the main body, a positioning portion is provided in the connector, the housing extends toward the connector to form a heat stake supporting and fixing the connector, the heat stake matches the positioning portion and passes through the positioning portion, and the connector is fixed to the housing after hot melting of the heat stake;

wherein the speaker box further comprising a fixing holder, wherein the fixing holder comprises an annular frame received in the receiving space and configured to fix the speaker unit, and a sound guide structure protruding from one side of the annular frame and extending out of the sidewall, the annular frame, the diaphragm and the metal top plate together define the front sound cavity, a sound guide through hole communicated with the front sound cavity is formed in the sound guide structure, one end of the sound guide structure away from the annular frame is provided with the sound output hole, and the sound output hole is communicated with the front sound cavity through the sound guide through hole.

2. The speaker box as described in claim 1, wherein the positioning portion is a through hole running through the connector.

3. The speaker box as described in claim 1, wherein the housing is provided with a positioning block corresponding to the connector, the positioning block is provided with a positioning slot configured to accommodate the connector, and the heat stake is formed in the positioning slot.

4. The speaker box as described in claim 3, wherein the connector comprises a bending portion connected to the main body and obliquely bending toward the bottom wall, and a connection portion protruding outwards from one side of the bending portion away from the main body and parallel to the main body, and the positioning portion is formed on the connecting portion.

5. The speaker box as described in claim 1, wherein the annular frame comprises an annular body and a stopper projecting from one end of an inner side of the annular body close to the metal top plate to a center of the annular body, and the annular body engages with the stopper to form a step limiting the speaker unit.

6. The speaker box as described in claim 5, wherein one side of the stopper away from the annular body forms an inclined surface towards the diaphragm.

7. The speaker box as described in claim 1, wherein an edge of the sidewall close to the metal top plate is provided with a mounting recess fitting with the sound guide structure.

8. The speaker box as described in claim 1, wherein the sound guide structure is further provided with a dust screen completely covering the sound output hole.

9. The speaker box as described in claim 8, wherein one end of the sound guide structure away from the annular frame is provided with a groove configured to mount and fix the dust screen.

10. A mobile terminal, comprising a housing having an accommodating cavity and a speaker box received in the accommodating cavity, a heat stake being formed on the housing, and the speaker box being positioned through cooperation between the positioning portion and the heat stake and being fixed to the housing after hot melting of the heat stake, wherein the speaker box comprises a shell having a receiving space and a speaker unit received in the receiving space and having a diaphragm, a front sound cavity is formed between the shell and the speaker unit, and the shell is provided with a sound output hole communicated with the front sound cavity;

wherein the shell comprises a bottom shell and a metal top plate covering the bottom shell, the bottom shell and the metal top plate together define the receiving space, the bottom shell comprises a bottom wall opposite to and spaced from the metal top plate and a sidewall bending and extending from a periphery of the bottom wall toward the metal top plate, the metal top plate comprises a main body covering one end of the sidewall away from the bottom wall and a connector extending outwards from the main body, a positioning portion is provided in the connector, the housing extends toward the connector to form the heat stake supporting and fixing the connector, the heat stake matches the positioning portion and passes through the positioning portion, and the connector is fixed to the housing after hot melting of the heat stake;

wherein the speaker box further comprising a fixing holder, wherein the fixing holder comprises an annular frame received in the receiving space and configured to fix the speaker unit, and a sound guide structure protruding from one side of the annular frame and extending out of the sidewall, the annular frame, the diaphragm and the metal top plate together define the front sound cavity, a sound guide through hole communicated with the front sound cavity is formed in the sound guide structure, one end of the sound guide structure away from the annular frame is provided with the sound output hole, and the sound output hole is communicated with the front sound cavity through the sound guide through hole.

* * * * *